US010472787B1

(12) United States Patent
Johnson et al.

(10) Patent No.: US 10,472,787 B1
(45) Date of Patent: Nov. 12, 2019

(54) CAP REPAIR ASSEMBLY

(71) Applicant: United States of America as Represented by The Secretary of The Army, Alexandria, VA (US)

(72) Inventors: August N Johnson, Raymond, MS (US); Michael I Hammons, Clinton, MS (US); Gary E Johnston, Rayville, LA (US); James C Ray, Clinton, MS (US)

(73) Assignee: UNITED STATES OF AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 0 days.

(21) Appl. No.: 15/984,190

(22) Filed: May 18, 2018

(51) Int. Cl.

| | |
|---|---|
| ***E02B 17/00*** | (2006.01) |
| ***E02B 3/06*** | (2006.01) |
| *E04G 23/02* | (2006.01) |
| *E02D 37/00* | (2006.01) |
| *E01D 22/00* | (2006.01) |

(52) U.S. Cl.
CPC ..... *E02B 17/0034* (2013.01); *E02B 3/06* (2013.01); *E01D 22/00* (2013.01); *E02D 37/00* (2013.01); *E04G 23/0218* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 4,880,203 | A * | 11/1989 | Holcomb | E04G 11/42 | 249/24 |
| 5,271,596 | A * | 12/1993 | Holcomb | E04G 17/18 | 249/211 |
| 5,277,405 | A * | 1/1994 | McSwain | B66F 3/08 | 254/98 |
| 5,893,253 | A * | 4/1999 | Lutz, III | E04B 5/12 | 52/291 |
| 7,748,180 | B1 * | 7/2010 | Plavidal | E04B 5/12 | 52/223.8 |
| 9,732,517 | B1 * | 8/2017 | Huang | E04B 1/985 | |
| 2012/0011665 | A1 * | 1/2012 | Porter | E04G 11/48 | 14/75 |
| 2016/0237711 | A1 * | 8/2016 | Powell | E04H 9/021 | |

* cited by examiner

*Primary Examiner* — Kyle Armstrong
(74) *Attorney, Agent, or Firm* — Brian C. Jones

(57) ABSTRACT

In certain embodiments, a cap repair assembly includes first and second pile brackets for rigid mounting onto first and second piles of a pier; a cap beam for rigid mounting onto super-structure of the pier; first and second cap beam plates for rigid mounting onto the cap beam at different ends of the cap beam; first and second compression arms rotatably connected (i) at first ends to the first and second pile brackets and (ii) at second ends to the first and second cap beam plates. The cap repair assembly restores the load capacity of damaged or degraded piers. The cap repair assembly can further include one or more steel banding straps.

14 Claims, 14 Drawing Sheets

CAP REPAIR ASSEMBLY

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

BACKGROUND

Field of the Invention

The present invention relates to techniques to rapidly restore load-bearing capacity to damaged or deteriorated timber piers and the like.

Description of the Need in the Art

This section introduces aspects that may help facilitate a better understanding of the invention. Accordingly, the statements of this section are to be read in this light and are not to be understood as admissions about what is prior art or what is not prior art.

During military operations, the U.S. military may need to use existing infrastructure to support its operations, such as the off-loading and on-loading of heavy vehicles, machinery, and other materials from and to ships using existing wooden piers, which might not be strong enough to support those loads, due to damage or deterioration of the pier materials.

There are currently no existing mechanical repair solutions for repairing degraded timber pier substructures an/or reinforce existing timber pier substructures to allow for a rapid and targeted strengthening for military use that can be installed by a few installers without use of heavy machinery.

Known techniques for restoring the load-bearing capacity of an existing damaged or degraded wooden pier may be insufficient for particular operations, such as off-loading tanks and other heavy machinery from a ship.

SUMMARY

Problems in the prior art are addressed in accordance with the principles of the present invention by providing an assembly that can be configured to restore the load-bearing capacity of a damaged or degraded wooden pier. In one embodiment, the assembly is a pile bridge assembly, while, in another embodiment, the assembly is a cap repair assembly.

The current invention as described below contemplates a set of components that can be assembled in multiple repair configurations to mitigate and address a range of substructure deteriorations and damages. Also, the current invention as described below allows for expedient constructability by using erection techniques and repair components that minimize the need for specialized tooling or standard heavy construction equipment, leading to reduced part count and resulting rapid installation times for such repairs. Moreover, the current invention uses components and processes that accommodate variability in target structure design and imperfections of target structure construction, such as variable pile diameters, pile spacing, and misalignment. Further, the current invention as described below provides for a portable, lightweight, and manageable modular system that allows for easier maneuvering from above deck and to sites below structure near and beneath the water line. Moreover, as described below, the current invention allows for a small team of personnel, as small as 2-3 or more, to be able to use the invention system to quickly install and buttress piers for restoring structural capacity without heavy machinery, in confined spaces, quickly, and cost, effectively.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a" an and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may, occur out of the order noted in the figures. For example, two figures shown in succession may in fact be executed substantially concurrently or may sometimes be executed in the reverse order, depending upon the functionality/acts involved.

Figure 1:
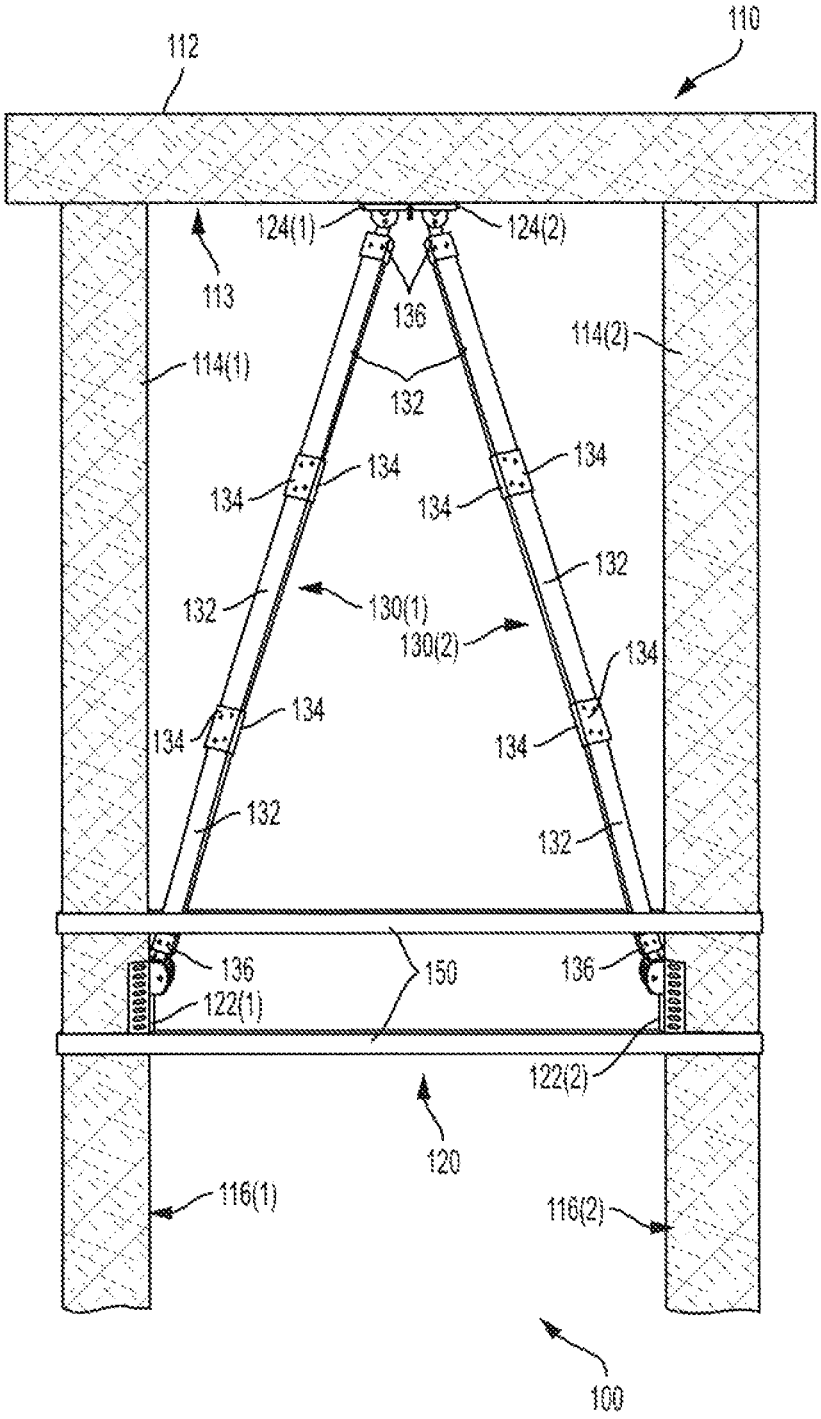
FIG. 1 is a front view of a portion of a strengthened pier according to one embodiment.

FIG. 1 is a front view of a portion of a restored pier 100 according to one embodiment. The restored pier 100 comprises, an existing pier 110 configured with a pile bridge assembly 120. The existing pier 110 includes a substantially horizontal wooden beam 112 (having a substantially rectilinear shape) spanning two substantially vertical wooden piles 114(1) and 114(2). Although not shown in FIG. 1, the existing pier 110 may include additional wooden piles analogous to piles 114(1) and 114(2) supporting additional wooden beams analogous to beam 112. In addition, although not shown in FIG. 1, the existing pier 110 may include additional structure supported on the upper sides of the horizontal beams. Although not explicitly depicted in FIG. 1, the piles 114(1) and 114(2) will typically be partially submerged in water. Although not shown in FIG. 1, the restored pier 100 may also have other suitable structure associated with piers.

The load-bearing capacity of the existing pier 110 is restored by connecting the pile bridge assembly 120 to the beam 112 and the two piles 114 as shown in FIG. 1. The pile bridge assembly 120 may be used, in a "gap" created by a damaged or missing pile in order to restore some capacity that was lost in the overall structure due to that damaged or missing pile. The pile bridge assembly 120 comprises:

- Two pile brackets 122(1) and 122(2) rigidly mounted onto two substantially vertical, inner-facing surfaces 116(1) and 116(2) of the two piles 114(1) and 114(2), respectively, using, e.g., suitable timber screws such as beaver screws;
- Two cap brackets 124(1) and 124(2) rigidly bolted together back-to-back and rigidly mounted onto the lower, substantially horizontal underside surface 113 of the beam 112 using, e.g., suitable timber screws such as timber-hex lag screws;
- Two compression arms 130(1) and 130(2) pivotally mounted between the two pile brackets 122(1) and 122(2) and the two cap brackets 124(1) and 124(2), respectively; and
- Two tension-managing straps 150, each tightly wrapped around the two piles 114(1) and 114(2) and vertically surrounding the two pile brackets 122(1) and 122(2).

Although the pile bridge assembly 120 comprises two cap brackets 124(1) and 124(2) that are bolted together to form a cap bracket sub-assembly that is mounted onto the beam 112, in alternative embodiments, the cap bracket sub-assembly could be implemented as a single, unitary construction. The straps 150 are referred to as tension-managing straps because they handle the tensile component of the truss that is formed by the pile bridge assembly 120.

Each compression arm 130 comprises three compression members 132 rigidly connected:

- To each other, end-to-end, by a pair of connection angled 134; and
- To the corresponding pile bracket 122 and to the corresponding cap bracket 124 by two respective, end connector assemblies 136.

Each compression member 132 is a hollow, metal, square tube that has a plastic foam, such as a closed-cell polyurethane, or other lighter-than-water material filling most of the tube's interior volume in order to increase the buoyancy of the member. This can be particularly useful when the pile bridge assembly 120 is configured at least partially in and/or under water. Each compression member 132 has captured nut features for bolts to thread into.

Figure 2A:
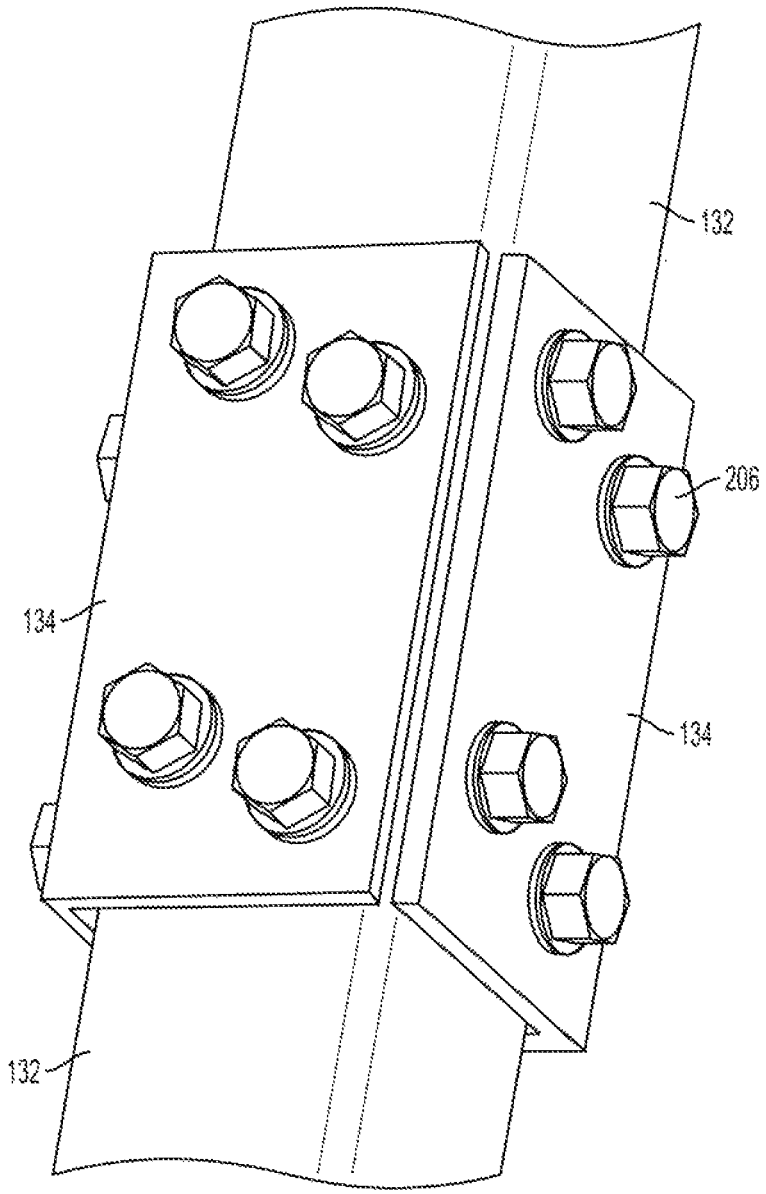
FIG. 2A is a perspective view of two compression members of FIG. 1 connected end-to-end by a pair of connection angles of FIG. 1.
Figure 2B:
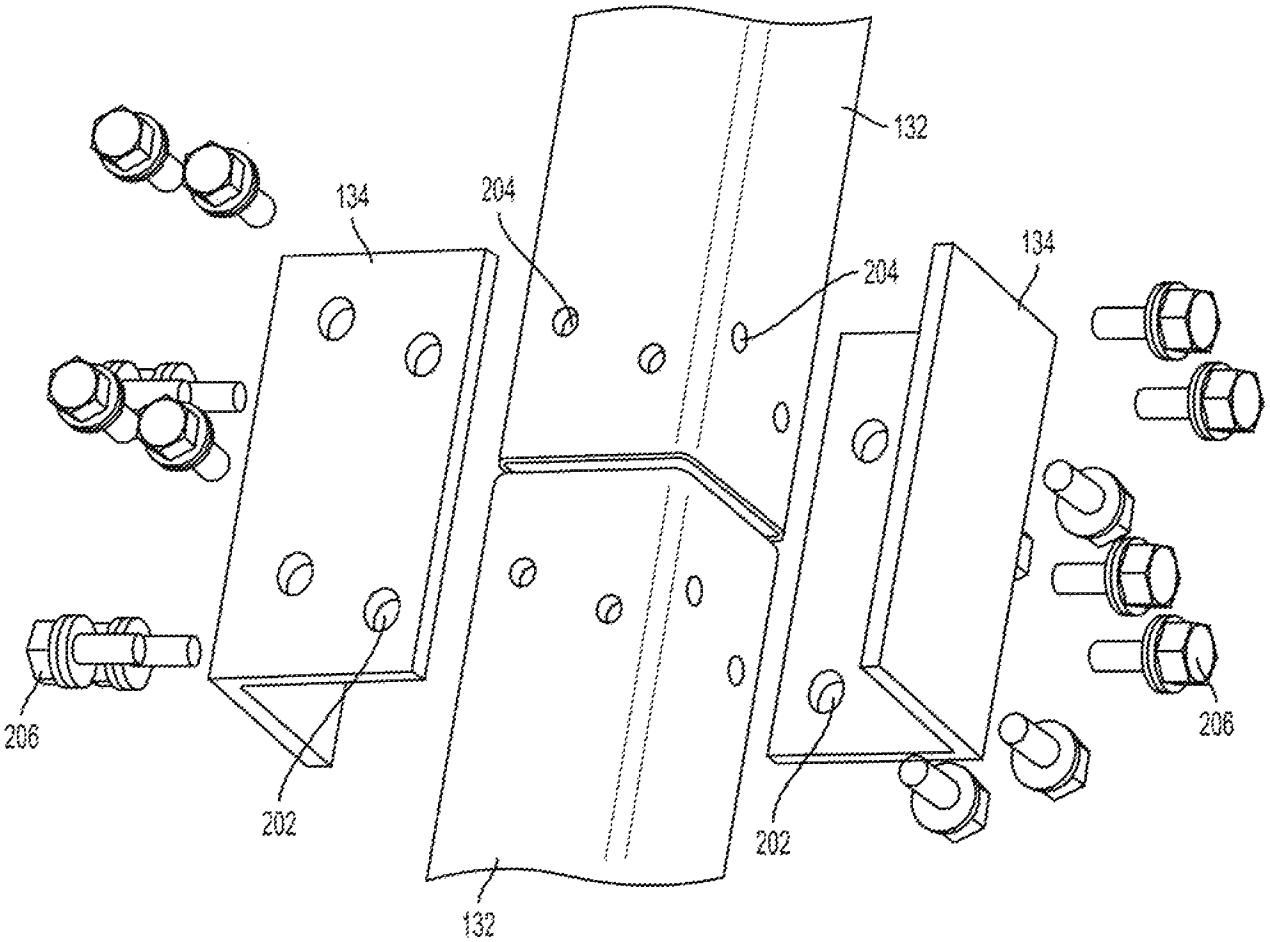
FIG. 2B is an exploded view of the assembly shown in FIG. 2A.

FIG. 2A is a perspective view of two compression members 132 connected end-to-end by a pair of connection angles 134, and FIG. 2B is an exploded view of the assembly shown in FIG. 2A. As shown in FIGS. 2A and 2B, the connection angles 134 have mounting holes 202 that align with corresponding tapped holes 204 in the compression members 132 such that the two connection angles 134 are rigidly connected to the two compression members 132 using suitable bolts 206.

Figure 3A:
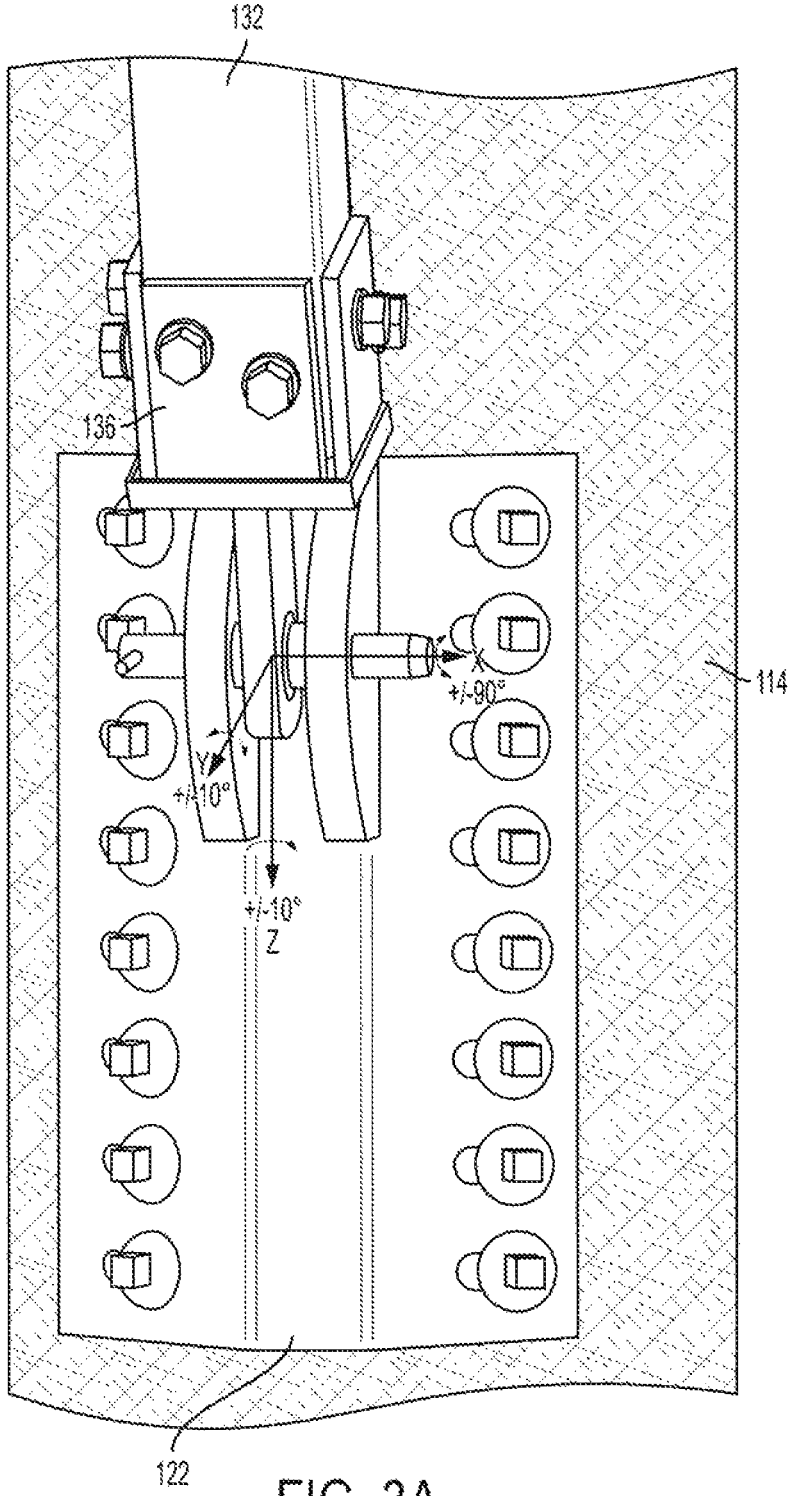
FIG. 3A is a perspective view of a compression member of FIG. 1 pivotally connected to a pile bracket of FIG. 1 by an end connector assembly of FIG. 1.
Figure 3B:
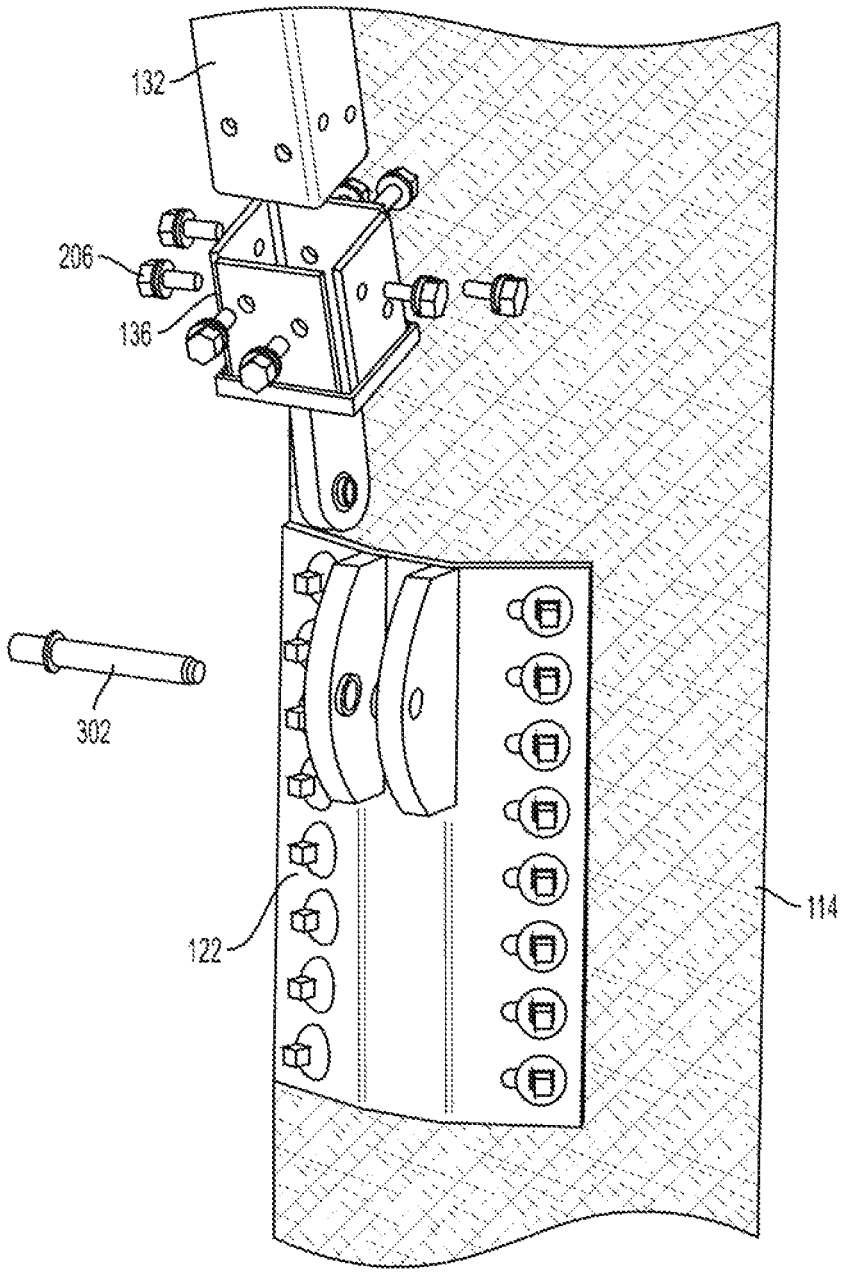
FIG. 3B is an exploded view of the assembly shown in FIG. 3A.

FIG. 3A is a perspective view of a compression member 132 pivotally connected to a pile bracket 122 by an end connector assembly 136, and FIG. 3B is an exploded view of the assembly shown in FIG. 3A. The end connector assembly 136 is rigidly connected to the compression member 132 using suitable bolts 206, and the, end connector assembly 136 is pivotally connected to the pile bracket 122 using a suitable clevis pin 302. In the assembly of FIGS. 3A and 3B, end connector assembly 136 allows rotation of the compression member 132 with respect to the pile bracket 122 by at least +/−90 degrees about the horizontal (X) axis and by about +/−10 degrees about the Y and Z axes in the coordinate system shown in FIG. 3A.

Figure 4A:
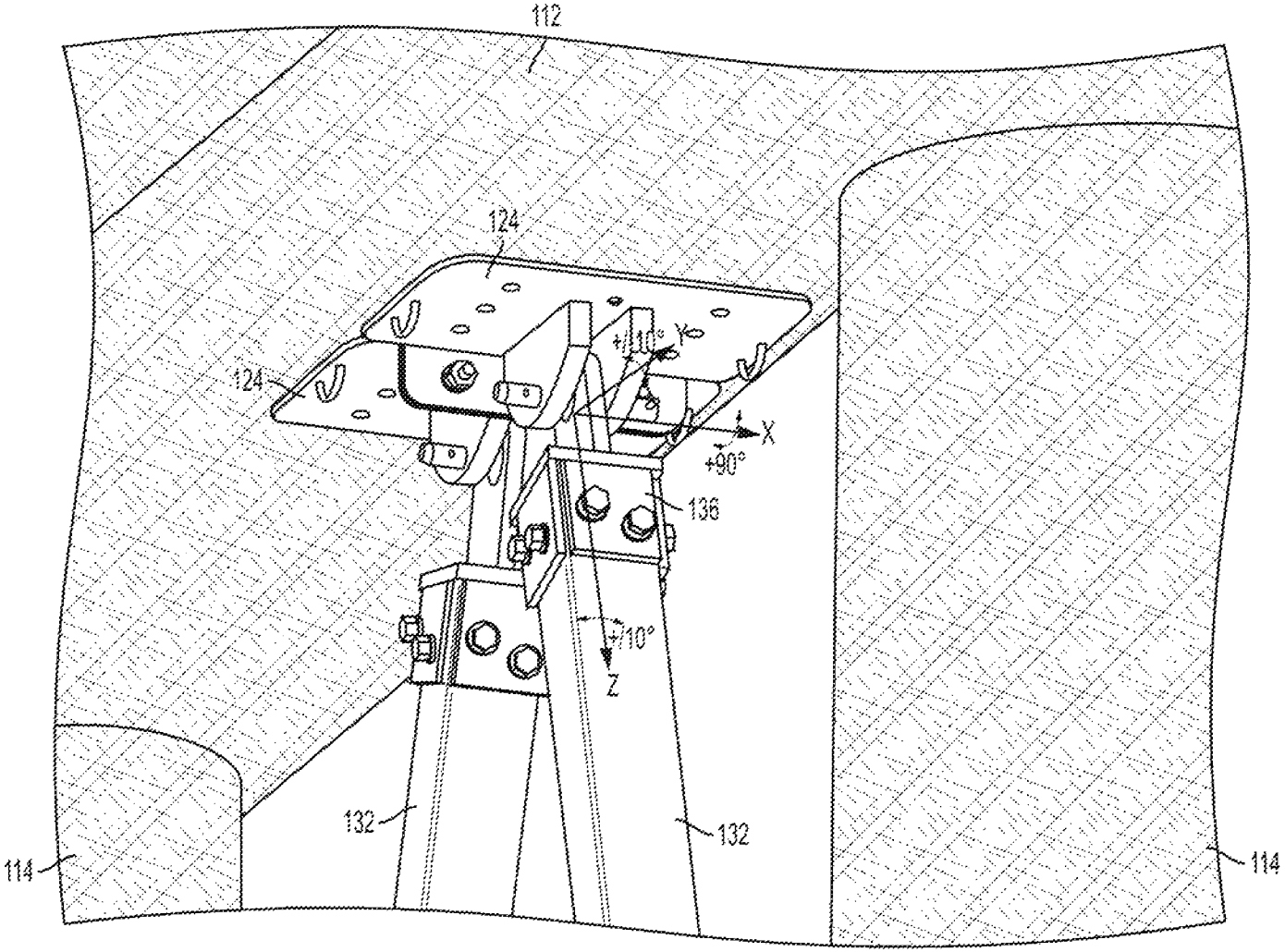
FIG. 4A is a perspective view of a compression member of FIG. 1 pivotally connected to a cap bracket of FIG. 1 by an end connector assembly of FIG. 1.
Figure 4B:
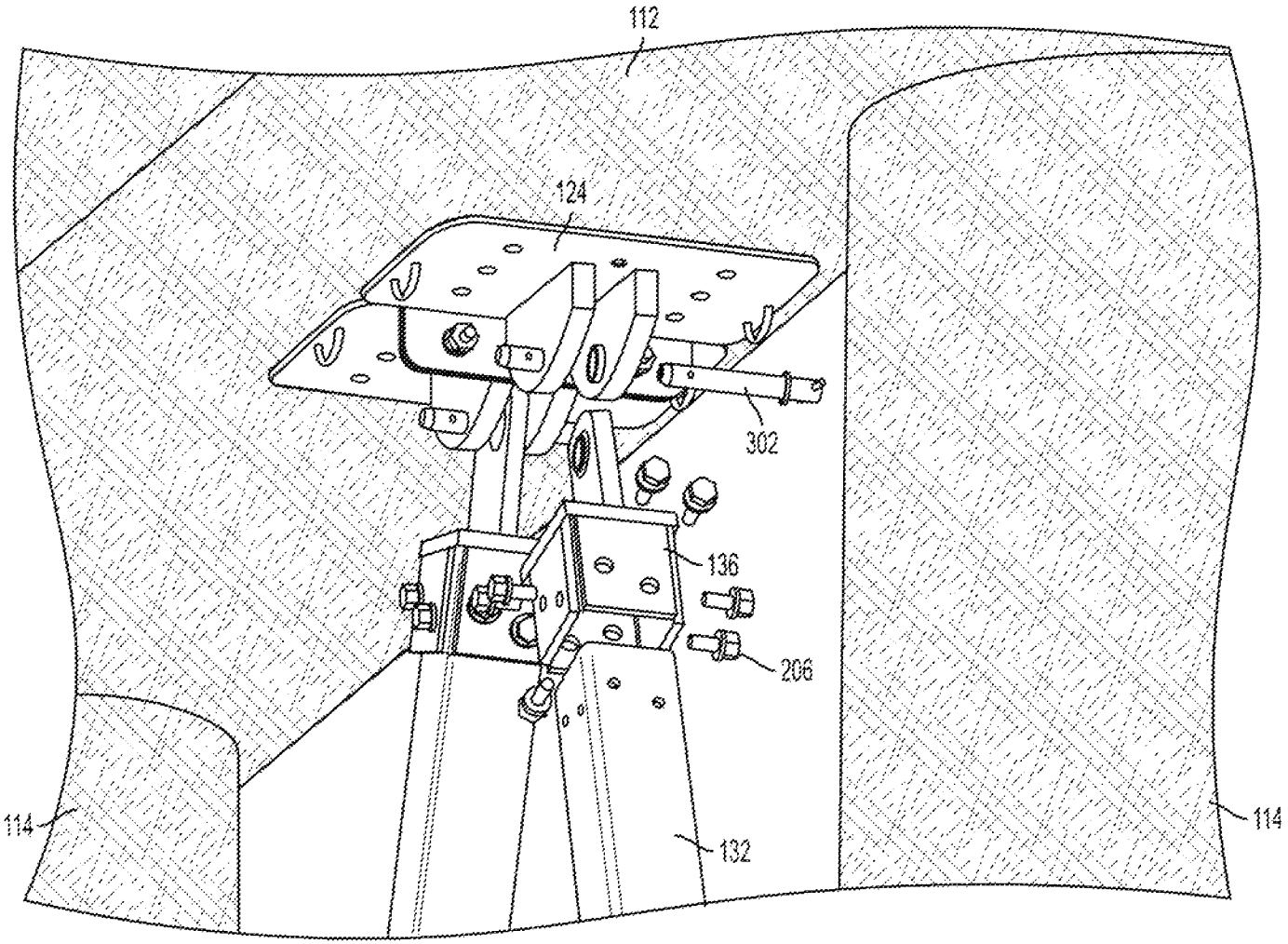
FIG. 4B is an exploded view of the assembly shown in FIG. 4A.

FIG. 4A is a perspective view of a pair of compression members 132 pivotally connected to a pair of cap brackets 124 by a pair of end connector assemblies 136, and FIG. 4B is a partially exploded view of the assembly shown in FIG. 4A. Each end connector assembly 136 is rigidly connected to the corresponding compression member 132 using suitable bolts 206, and each end connector assembly 136 is pivotally connected to the corresponding cap bracket 124 using a suitable clevis pin 302. In the assembly of FIGS. 4A and 4B, each end connector assembly 136 allows rotation of the corresponding compression member 132 with respect to the corresponding cap bracket 124 by about 90 degrees between vertical and horizontal in FIG. 1 (if the neighboring piles 114 were not in the way) and by about +/−10 degrees into and out of the paper plane of FIG. 1.

Figure 5:
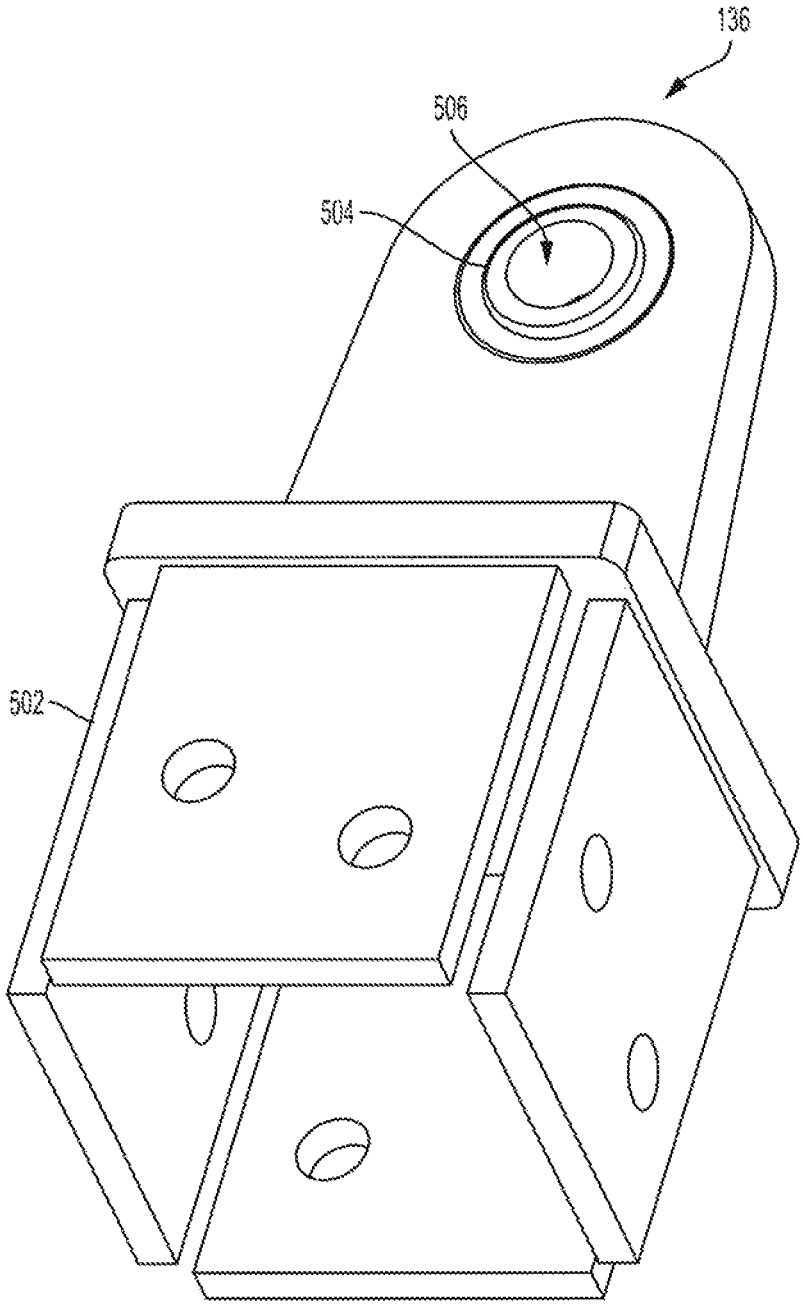
FIG. 5 is a perspective view of an end connector assembly 136 of FIG. 1.

FIG. 5 is a perspective view of are end connector assembly 136, which comprises:

- An end housing 502 configured to mate to the corresponding compression member 132 using suitable bolts; and
- A swivel bearing 504 configured to be mounted within an opening 506 in the end housing 502 and having an aperture 506 configured to receive a clevis pin 302.

Each swivel bearing 504 (also known as a spherical joint or heim joint) provides the two degrees of rotational freedom between a corresponding compression arm 130 and either the corresponding pile bracket 122 or the corresponding cap bracket 124.

The ability of the end connector assemblies 136 to support those two different degrees of rotational freedom between each compression arm 130 and both the corresponding pile bracket 122 and the corresponding cap bracket 124, enables the pile bridge assembly 120 to be configured to existing piers 110 having different horizontal distances between the two vertical piles 114(1) and 114(2) as well as acceptable ranges of deviations from true, square angles between the piles 114(1) and 114(2) and the beam 112.

Moreover, in alternative configurations of the pile bridge assembly 120, each compression arm 130 may be configured with fewer than or more than three compression members 132. In this way, the pile bridge assembly 120 can be configured for piers 110 having different horizontal distances between piles 114 and/or different heights of piles 114 and/or different vertical distances between the mounting locations of the pile brackets 122 and the horizontal beam 112. Note that a single pile bridge assembly 120 may be configured with different numbers of compression members 132 in its two compression arms 130(1) and 130(2). Note that increasing overall arm lengths or decreasing arm angle with the horizontal would decrease the capacity of the repair relative to the target capacity. The configuration of FIG. 1 having three-member compression arms 130 can be optimized for a pile spacing range of 5-7 feet (center to center).

Figure 6A:
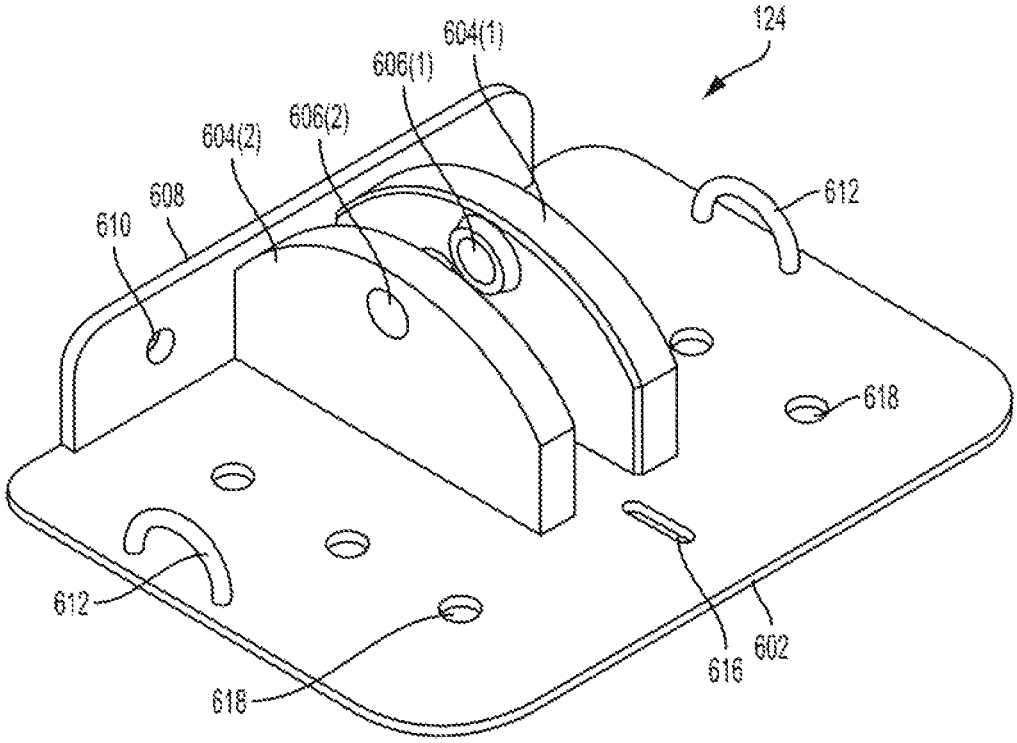
FIG. 6A is a perspective view of a cap bracket of FIG. 1

FIG. 6A is a perspective view of a cap bracket 124 comprising:

- A mounting plate 602 for mounting the cap bracket 124 to the horizontal beam 112;
- Two clevis plates 604(1) and 604(2) having clevis pin holes 606(1) and 606(2), respectively, for receiving a clevis pin 302;
- A mounting flange 608 having bolt holes 610 for bolting two cap brackets 124 together back-to-back using suitable nuts and bolts; and
- Two lifting loops 612 used to lift a compression arm 130 into position to be mated to the cap bracket 124, as described further below.

Figure 6B:
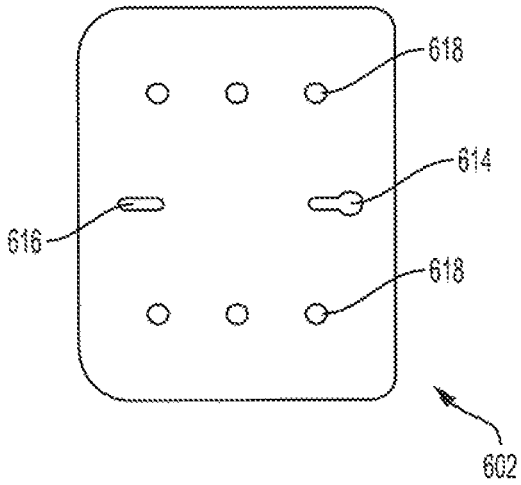
FIG. 6B is a plan view of the mounting plate of FIG. 6A.

FIG. 6B is a plan view of the mounting plate 602 of the cap bracket 124 having a slotted keyhole 614, a slot 616, and two sets of three holes 618. The slotted keyhole 614 and the slot 616 are used to mount the cap bracket 124 to the underside surface 113 of the wooden beam 112 using suitable timber screws. The slotted keyhole 614 enables the assembler to partially drive in a lag screw into the beam 112, hang the cap bracket 124 from the beam 112 with that lag screw positioned within the slotted keyhole 614, drive another lag screw through the slot 616 into the beam 112, and then complete the mounting of the cap bracket 124 by finishing the driving of the first lag screw into the beam 112, thereby enabling the assembler to mount the cap bracket 124 onto the underside surface 113 of the beam 112 without having to manually support the weight of the cap bracket 124 throughout the mounting process. The mounting holes 618 are not needed in this particular application of the cap bracket 124.

Figure 7:
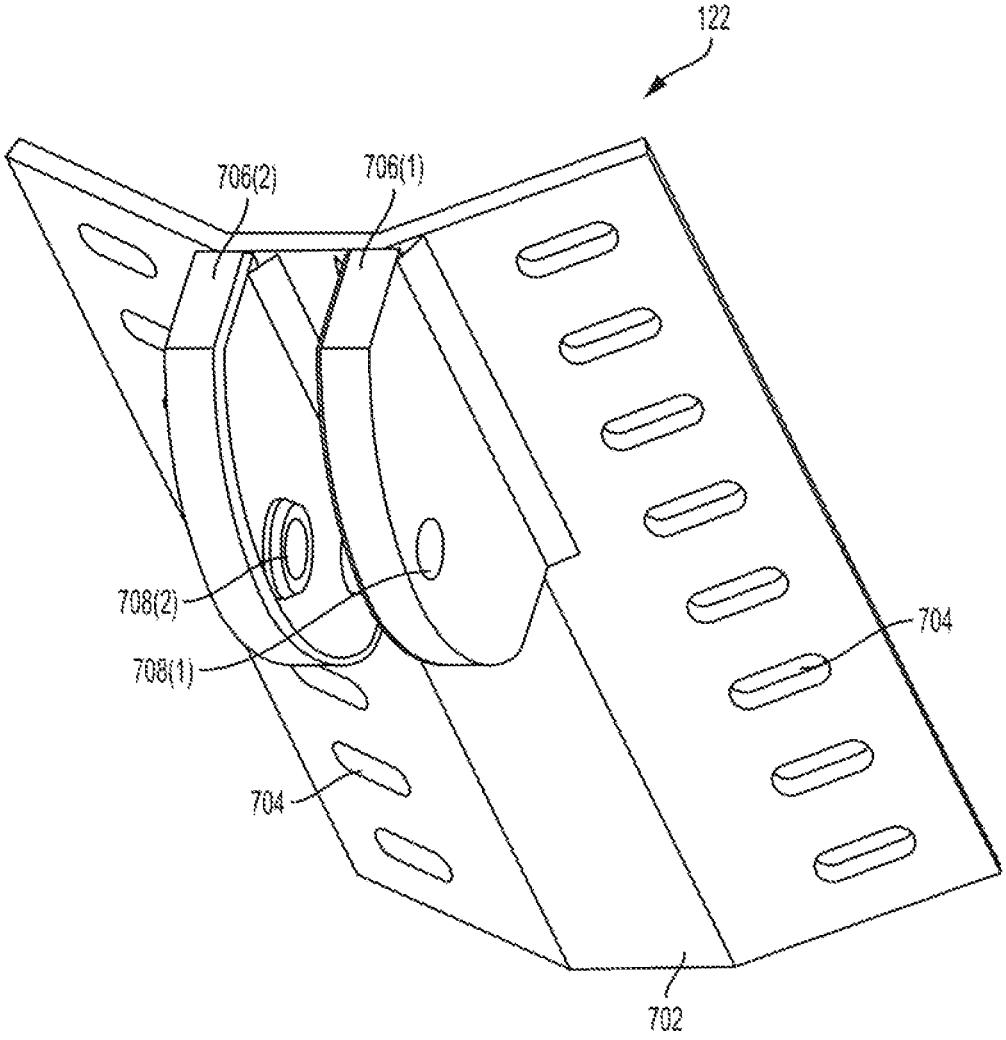
FIG. 7 is a perspective view of a pile bracket of FIG. 1.

FIG. 7 is a perspective view of a pile bracket 122 comprising:

- A mounting plate 702 having a bent shape and mounting slots 704 for rigidly mounting the pile bracket 122 to a pile 114 using suitable timber screws; and
- Two clevis plates 706(1) and 706(2) having clevis pin holes 708(and 708(2), respectively, for receiving a clevis pin 302, where clevis plates 706 are welded to the mounting plate 702.

Wooden piles, like piles 114 of FIG. 1, are typically substantially cylindrical in shape, but can vary in diameter from pile to pile within a pier and between different piers. The bent shape of the mounting plate 702 (instead of a flat shape) and the presence of mounting slots 704 (instead of circular mounting holes) enable a single design for the pile bracket 122 to support the rigid mounting of different instances of the pile bracket 122 to any of a number of different piles 114 having a typical range of different diameters.

The clevis plates 706 are welded at one end of the mounting plate 702 (rather than centered) to handle the different load cases on the timber screws used to mount the pile bracket 122 to a pile that occur in different assemblies. As shown in the pile bridge assembly 120 of FIG. 1, each pile bracket 122 is mounted in the "knuckles up" orientation to have the center of the load applied through the compression arms 130 to react at the centers of the timber screws attaching the pile bracket 122 to the pile. In the cap repair assembly 820 of FIG. 8 (described below), the pile brackets 822 are mounted in the "knuckles down" orientation. The offset clevis plates 706 provide a balance between these different load cases.

The various components of the pile bridge assembly 120 of FIG. 1 can be configured to form the restored pier 100 of FIG. 1 from the existing pier 110 of FIG. 1 according to the following sequence of steps:

1. Pre-assemble the two compression arms 130(1) and 130(2) using six compression members 132, eight connection angles 134, and two end connector assemblies 136;
2. Pivotally connect a pile bracket 122 to the end connector assembly 136 at one end of each compression arms 130 using a clevis pin 302;
3. Rigidly mount first cap bracket 124(1) to the underside surface 113 of beam 112, then rigidly bolt second cap bracket 124(2) back-to-back to first cap bracket 124(1) at mounting flanges 608, and then rigidly mount second cap bracket 124(2) to the underside surface 113 of beam 112 (alternatively, first rigidly bolt the two cap brackets 124 back-to-back and then rigidly mount the bolted cap brackets 124 to the underside surface 113 of beam 112;
4. Using one or both lifting loops 612 of the first mounted cap bracket 124(1) and a suitable pulley system, lift the first pre-assembled compression arm 130(1) in place to insert a clevis pin 302 through the first clevis pin, hole 606(1), then through the aperture 506 in the swivel bearing 504 of the corresponding end connector assembly 136, and then through the second clevis pin hole 606(2), and secure the clevis pin 302 in place using the associated hardware;
5. Repeat step 4 for the second pre-assembled compression 130(2) and the second mounted cap bracket 124 (2);
6. Rotate the lower end of the first pre-assembled compression arm 130(1) (with the first pile bracket 122(1) already pinned to the end connector assembly 136 at the end of the compression arm) to the first pile 114(1) to rigidly mount the first pile bracket 122(1) to the first pile 114(1) using, e.g., timber screws;
7. Repeat step 6 for the second compression arm 130(2), the second pile 114(2), and the second pile bracket 122(2); and
8. Wrap each of the two tension-managing straps 150 around the two pile 114(1) and 114(2) and tighten using a suitable ratcheting mechanism.

Those skilled in the art will understand that other sequences of steps can be used to configure the pile bridge assembly 120 to the existing pier 110.

Figure 8:
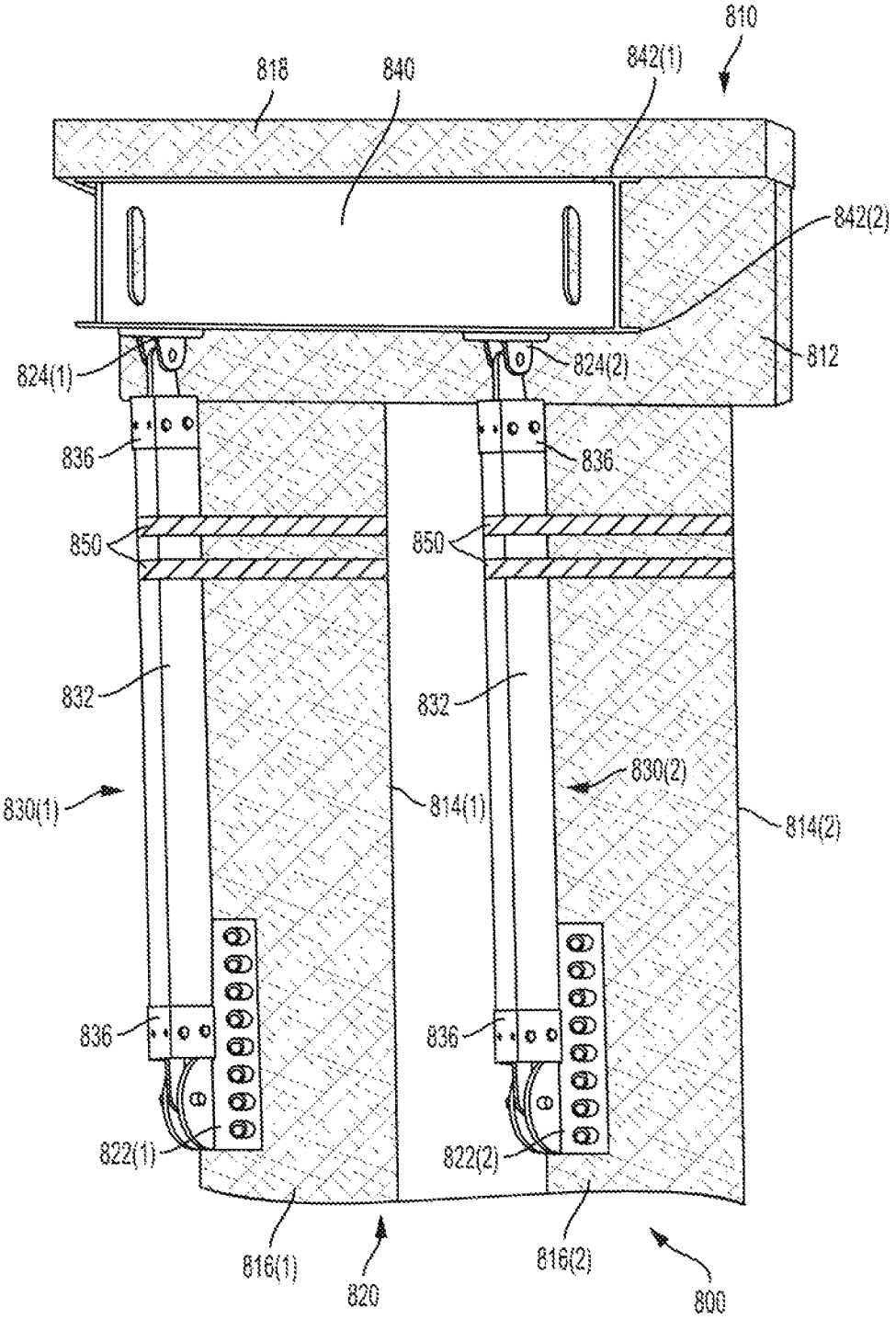
FIG. 8 is a perspective view of a portion of a strengthened pier according to another embodiment.

FIG. 8 is a perspective view of a portion of a restored pier 800 according to another embodiment. The restored pier 800 comprises an existing pier 810 configured with a cap repair assembly 820. The existing pier 810 includes a substantially horizontal wooden beam 812 spanning two substantially vertical wooden piles 814(1) and 814(2). Although not shown in FIG. 8, the existing pier 810 may include additional wooden piles analogous to piles 814(1) and 814(2) supporting additional wooden beams analogous to beam 812. In addition, although not shown in FIG. 8, the existing pier 810 may include additional super-structure 818 (such as stringers and decking) supported on the upper sides of the horizontal beams. Although not explicitly depicted in FIG. 8, the piles 814(1) and 814(2) will typically be partially submerged in water. Although not shown in FIG, 8, the restored pier 800 may also have other suitable structure associated with piers.

The load-bearing capacity of the damaged or degraded wooden pier 810 has been restored by connecting the cap repair assembly 820 to the two piles 814 as shown in FIG. 8. The cap repair assembly 820 comprises:

- Two pile brackets 822(1) and 822(2) rigidly mounted onto two substantially vertical, front-facing sides 816(1) and 816(2) of the two piles 814(1) and 814(2), respectively, using, e.g., suitable timber screws such as beaver screws;
- A metal cap beam 840 having bolt holes (not shown in FIG. 8) on its two flange plates 842(1) and 842(2), where, e.g., suitable timber screws such as timber-hex lag screws are used to rigidly mount the cap beam 840 at its upper flange plate 842(1) to the underside of wooden pier super-structure 818 that is supported by the horizontal beam 812;
- Two cap beam plates 824(1) and 824(2) rigidly mounted onto the cap beam 840 at its lower flange plate 842(2) using, e.g., suitable nuts and bolts;
- Two compression arms 830(1) and 830(2) pivotally remounted between the two pile brackets 822(1) and 822(2) and the two cap beam plates 824(1) and 824(2), respectively; and
- Banding straps 850, where one or more are tightly wrapped around the first pile 814(1) and the first compression arm 830(1) and one or more are tightly wrapped around the second pile 814(2) and the second compression arm 830(2).

In a preferred implementation, the pile brackets 822(1) and 822(2) are identical to the pile brackets 122(1) and 122(2) of FIG. 1.

Each compression arm 830 comprises a single compression member 832 connected to the corresponding pile bracket 822 and to the corresponding cap beam plate 824 by two respective end connector assemblies 836. In a preferred implementation, the compression members 832 are identical to the compression members 132 of FIG. 1, and the end connector assemblies 836 are identical to the end connector assemblies 136 of FIG. 1.

Although not depicted in FIG. 8, a second instance of the cap repair assembly 820 can be configured on the opposite side of the same two piles 814(1) and 814(2) to further restore the load-bearing capacity of the pier 810.

In alternative configurations of the cap repair assembly 820, each compression arm 830 may be configured with more than one compression member 832 (e.g., using connection angles 134 of FIG. 1). In this way, the cap repair assembly 820 can be configured for piers 810 having different heights of piles 814 and/or different vertical distances between the mounting locations of the pile brackets 822 and the cap beam 840. Note that a single cap repair assembly 820 may be configured with different numbers of compression members 832 in its two compression arms 830(1) and 830(2). This flexibility is important when the pile condition varies along the lengths of the piles such that "good timber" may exist at different levels for different piles.

Figure 9A:
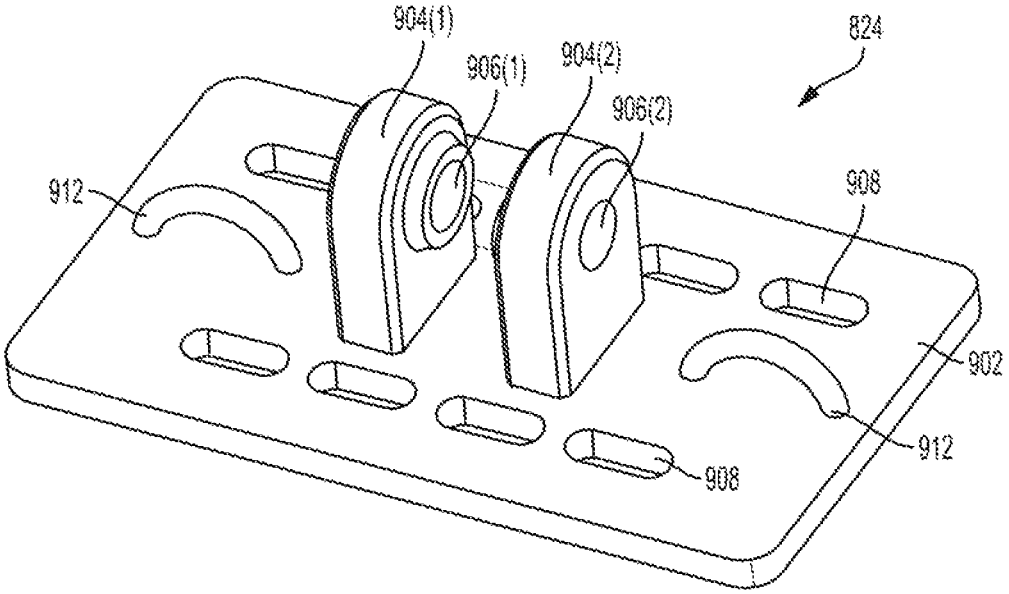
FIG. 9A is a perspective view of a cap bracket of FIG. 8.

FIG. 9A is a perspective view of a cap beam plate 824 comprising:

- A mounting plate 902 having bolt slots 908 for rigidly mounting the cap beam plate 824 to the cap beam 840 at its lower flange plate 842(2) using, e.g., suitable nuts and bolts.
- Two clevis plates 904(1) and 904(2) having clevis pin holes 906(1) and 906(2), respectively, for receiving a clevis pin 302; and
- Two lifting loops 912 used to lift a compression arm 830 into position to be mated to the cap beam plate 824, as described further below.

Figure 9B:
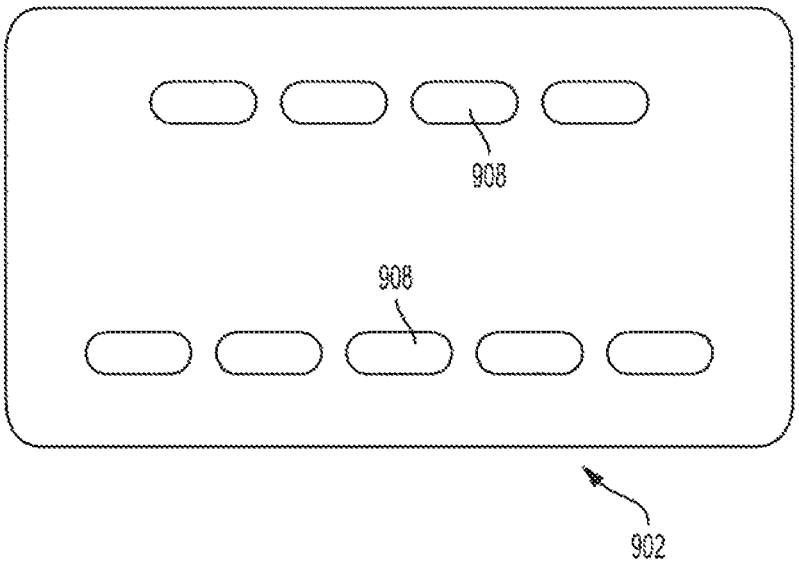
FIG. 9B is a plan view of the mounting plate of FIG. 9A.

FIG. 9B is a plan view of the mounting plate 902 of the cap beam plate 824. As shown in FIG. 9B, the mounting plate 902 of the cap beam plate 824 has four bolt slots 908 along one edge of the plate and five bolt slots 908 along the other edge that enable the cap beam plate 824 to be mounted onto the lower flange plate 842(2) of the cap beam 840 using bolts that pass through the bolt slots 908 and the corresponding bolt holes in the lower flange plate 842(2). The spacing and size of the slots 908 enable the cap beam plate 824 to be mounted at any location along the length of the cap beam 840, by selectively rotating the cap beam plate 824 by 180 degrees with respect to the vertical direction in FIG. 8. Ideally, each cap bean plate 824 is mounted to line up with the vertical centerline of the corresponding pile 814.

Figure 10A:
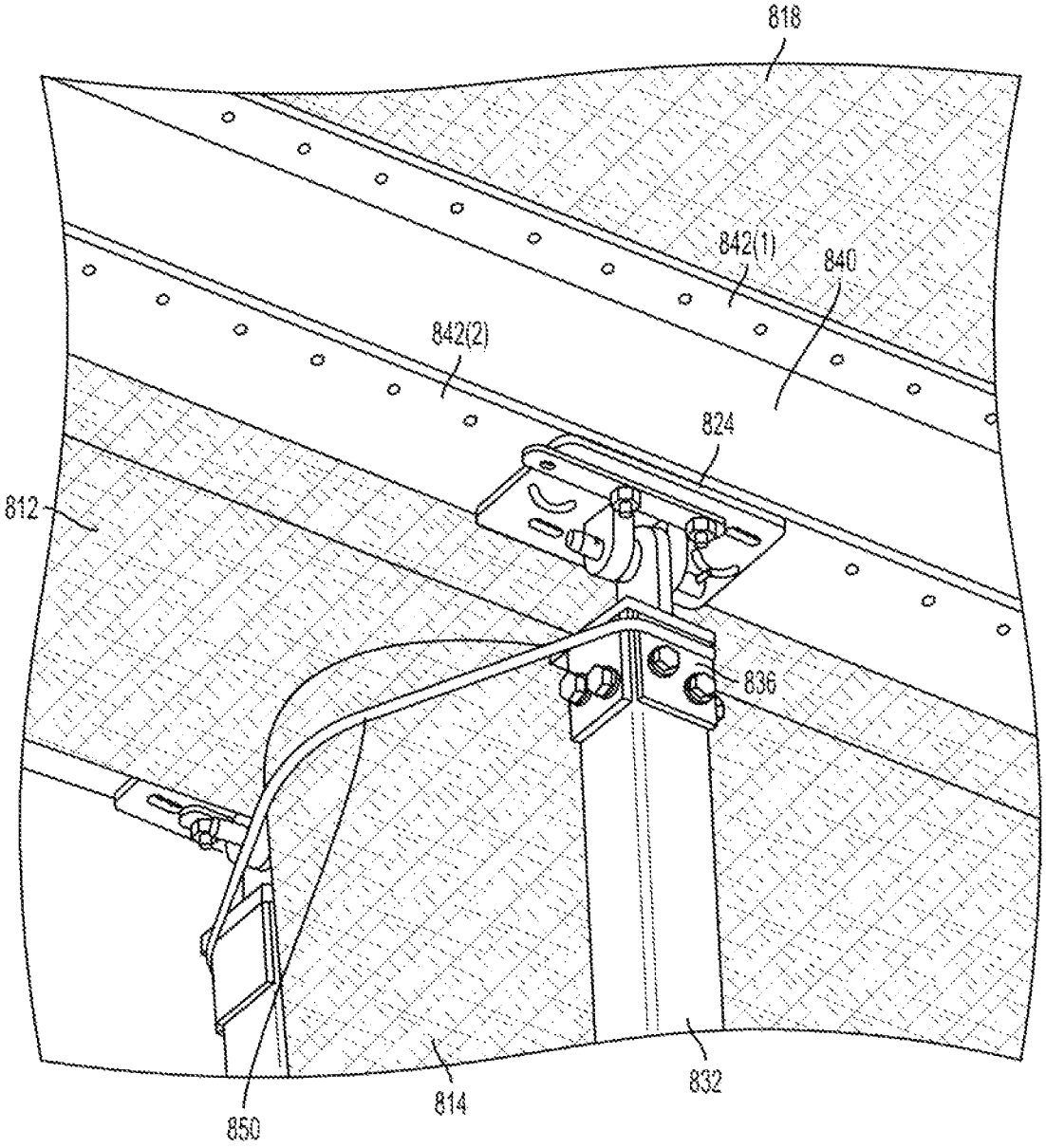
FIG. 10A is a perspective view of a compression member of FIG. 8 pivotally connected to a cap beam plate of FIG. 8 by an end connector assembly of FIG. 8.
Figure 10B:
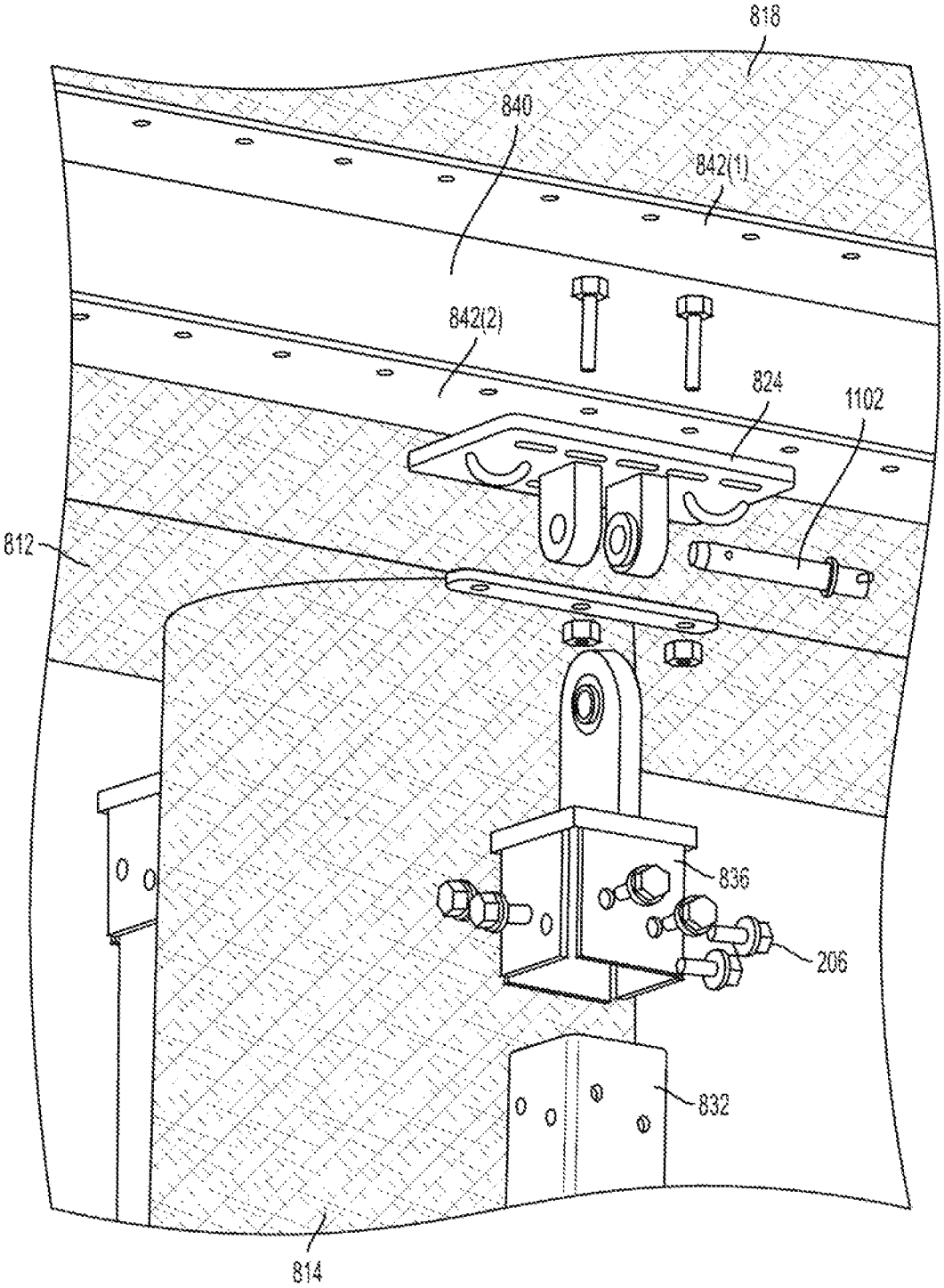
FIG. 10B is an exploded view of the assembly shown in FIG. 10A.

FIG. 10A is a perspective view of a compression member 832 pivotally connected to a cap beam plate 824 by an end connector assembly 836, and FIG. 10B is an exploded view of the assembly shown in FIG. 10A. The end connector assembly 836 is rigidly connected to the compression member 832 using suitable bolts, and the end connector assembly 836 is pivotally connected to the cap beam plate 824 using a suitable clevis pin 1102. In the assembly of FIGS. 10A and 10B, end connector assembly 836 allows rotation of the compression member 832 with respect to the cap beam plate 824 by about 90 degrees between vertical and horizontal in FIG. 8 (if the neighboring piles were not in the way) and by about +/−10 degrees into and out of the paper plane of FIG. 8.

The various components of the cap repair assembly 820 of FIG. 8 can be configured to form the restored pier 800 of FIG. 8 from the existing pier 810 of FIG. 8 according to the following sequence of steps:

1. Pre-assemble the two compression arms 830(1) and 830(2) using two compression members 832 and four end connector assemblies 836;
2. Rigidly mount the cap beam 840 to the underside of the wooden pier super-structure 818 using, e.g., timber screws through the mounting holes in the upper flange plate 842(1) of the cap beam 840;
3. Rigidly bolt the two cap beam plates 824(1) and 824(2) to the lower flange plate 842(2) of the cap beam 840 aligning each cap beam plate 824 with the center of the corresponding pile 814;
4. Using one or both lifting loops 912 of the first mounted cap beam plate 824(1) and a suitable pulley system (not shown), lift the first pre-assembled compression arm 830(1) in place to insert a clevis pin 302 through the first clevis pin hole 906(1), then through the aperture in the swivel bearing of the corresponding end connector assembly 838 at the upper end of the compression arm 830(1), and then through the second clevis pin hole 906(2), and secure the clevis pin 302 in place;
5. Repeat step 4 for the second pre-assembled compression 830(2) and the second mounted cap beam plate 824(2);
6. Pivotally connect a pile bracket 822 to the end connector assembly 836 at the lower end of each compression arm 830 using a clevis pin 302;
7. Rotate the lower end of the first compression arm 830(1) to the first pile 814(1) ,to mount the first pile bracket 822(1) to the first pile 814(1) using, e.g., timber screws;

8. Repeat step 7 for the second compression arm 830(2), the second pile 814(2), and the second pile bracket 822(2);
9. Wrap the first pile 814(1) and the first compression arm 830(1) with one or more tensioned steel banding straps 850; and
10. Repeat step 9 for the second pile 814(2) and the second compression arm 830(2).

Those skilled in the art will understand that other sequence of steps can be used to configure the cap repair assembly 820 to the existing pier 810.

The following are examples of commercial, off-the-shelf products that can be used for some of the components of the pile bridge assembly 120 and the cap repair assembly 820:

Clevis pins 302/1102: Quick-Release Pin Model/Part No. 98325A880 from McMaster-Carr Supply Company of Elmhurst, Ill.;

Tension-managing straps 150: Ratchet Strap Model/Part No. BL8530CE from US Cargo Control of Urbana, Iowa;

Banding straps 850; BAND-IT 201 Stainless Steel Bands from BAND-IT of Denver, Colo.;

Timber screws: Timber-Hex HDG Screw Model/Part No. SDWH27600 from Simpson Strong-Tie Company Inc. of Pleasanton, Calif.;

Beaver screws: Fasteners P/N 11346 from United Steel and Fasteners Inc. of Itasca, Ill.;

Swivel bearings 504: Spherical Bearing Model/Part No. HCOM16T from QA1 Precision Products Inc. of Lakeville, Minn.;

The remaining components of the assemblies 120 and 820 may be custom fabricated.

Except for the cap beam 840, which is preferably made of aluminum, and the tension-managing straps 150, the rest of the components of the pile bridge and cap repair assemblies 120 and 820 are preferably and substantially made of painted, structural-grade steel. Other suitable materials are also possible for any of the components.

Note that one or more instances of the pile bridge assembly 120 of FIG. 1 and/or one, or more instances of the cap repair assembly 820 of FIG. 8 can be connected in a single pier, including to both types of assemblies being configured to a single pair of piles. Moreover, prior-art techniques such as pile banding and cross bracing can be applied within the same pier.

In order to configure a pier with one instance of the pile bridge assembly 120 of FIG. 1, a pile bridge assembly kit may be provided that contains a sufficient number of each of the various components in the corresponding assembly. Similarly, in order to configure a pier with one instance of the cap repair assembly 820 of FIG. 8, a cap repair assembly kit may be provided that contains a sufficient number of each of the various components in the corresponding assembly. Multiple instances of each assembly kit may be provided to enable configuration of multiple instances of each corresponding assembly. Moreover, a combined assembly kit may be provided that has a sufficient number of each of the various components needed to configure either one instance of the pile bridge assembly 120 or one instance of the cap repair assembly 820. Here, too, multiple instances of the combined assembly kit may be provided to enable multiple instances of the pile bridge assembly 120 and/or the cap repair assembly to be configured, one assembly per kit.

In certain embodiments, the invention is a cap repair assembly comprising:

a first pile bracket configured to be rigidly mounted onto a first pile of a pier;

a second pile bracket configured to be rigidly mounted onto a second pile of the pier;

a cap beam configured to be rigidly mounted onto superstructure of the pier;

a first cap beam plate rigidly mounted onto the cap beam at a first end of the cap beam;

a second cap beam plate rigidly mounted onto the cap beam at a second end of the cap beam;

a first compression arm rotatably connected (i) at a first end to the first pile bracket and (ii) at a second end to the first cap beam plate; and a second compression arm rotatably connected (i) at a first end to the second pile bracket and (ii) at a second end to the second cap beam plate.

In certain embodiments of the foregoing, when the assembly is configured to the pier, the first and second compression arms are substantially vertical.

In certain embodiments of the foregoing, when the assembly is configured to the pier.

the first and second pile brackets are rigidly mounted onto substantially vertical, front-facing surfaces of the first and second piles; and the first and second cap beam plates are rigidly mounted onto a substantially horizontal, underside surface of the cap beam.

In certain embodiments of the foregoing:

the first compression arm is rotatable with respect to the first cap beam plate by about 90 degrees about a first axis of rotation and by about +/−10 degrees about a second axis of rotation orthogonal to the first axis of rotation;

the second compression arm is rotatable with respect to the second cap beam plate by about 90 degrees about a first axis of rotation and by about +/−10 degrees about a second axis of rotation orthogonal to the first axis of rotation;

the first compression arm is rotatable with respect to the first pile bracket by about +/−90 degrees about a first axis of rotation and by about +/−10 degrees about a second axis of rotation orthogonal to the first axis of rotation; and the second compression arm is rotatable with respect to the second pile bracket by about +/−90 degrees about a first axis of rotation and by about +/−10 degrees about a second axis of rotation orthogonal to the first axis of rotation.

In certain embodiments of the foregoing, the assembly further comprises at least one steel banding strap configured to be wrapped around the first compression arm and the first pile.

In certain embodiments of the foregoing, the first cap beam plate comprises:

a mounting plate having first and second rows of different numbers of mounting slots;

two clevis plates rigidly connected to the mounting plate and having corresponding clevis pin holes; and two lifting loops rigidly connected to the mounting plate.

In certain embodiments of the foregoing, the first compression arm comprises a hollow, metal tube having a lighter-than-water material inside the interior volume of the tube.

In certain embodiments of the foregoing, an end connector assembly is rigidly connected to each end of the first compression arm, and each end connector assembly comprises a swivel bearing that enables the rotatable connection between the first compression arm and one of the first pile bracket and the first cap beam plate.

In certain embodiments of the foregoing, the first pile bracket has a mounting plate with a bent shape that enables different instances of the first pile bracket to be mounted onto different piles having different diameters.

In certain embodiments, the invention is a method for configuring the cap repair assembly, the method comprising the steps of:

(1) rigidly mounting the cap beam onto the super-structure;

(2) rigidly mounting the first and second cap beam plates onto the cap beam;

(3) rotatably connecting the first end of the first compression arm to the first pile bracket;

(4) rotatably connecting the first end of h second compression arm to the second pile bracket;

(5) rotatably connecting the second end of the first compression arm to the first cap beam plate;

(6) rotatably connecting the second end of the second compression arm to the second cap beam plate;

(7) rotating the first compression arm with respect to the first cap beam plate and rigidly mounting the first pile bracket to the first pile; and (8) rotating the second compression arm with respect to the second cap beam plate and rigidly mounting the second pile bracket to the second pile.

In certain embodiments of the foregoing:

step (1) is performed before step (2);

step (2) is performed before steps (5) and (6);

step (3) is performed before step (5);

step (4) is performed before step (6);

steps (3) and (5) are performed before step (7); and steps (4) and (6) are performed before step (8).

In certain embodiments of the foregoing, the method further comprises the, step of (9) wrapping at least one steel banding strap around the first compression arm and the first pile, wherein step (9) is performed after steps (1)-(8).

In certain embodiments of the foregoing, the method further comprises the step of (9) rigidly connecting an end connector assembly to each end of the first compression arm wherein step (9) is performed before steps (3) and (5), and each end connector assembly comprises a swivel bearing that enables the rotatable connection between the first compression arm and one of the first pile bracket and the first cap beam plate.

In certain embodiments, the invention is an assembly kit for the cap repair assembly, the assembly kit comprising:

the first and second pile brackets;

the first and second cap beam plates; and a plurality of compression members and four end connector assemblies configured to form the first and second compression arms.

In certain embodiments of the foregoing, the first cap beam plate comprises:

a mounting plate having first and second rows of different numbers of mounting slots;

two clevis plates rigidly connected to the mounting plate and having corresponding clevis pin holes; and two lifting loops rigidly connected to the mounting plate.

In certain embodiments of the foregoing, at least one compression member comprises a hollow, metal tube having a lighter-than-water material inside the interior volume of the cylinder.

In certain embodiments of the foregoing, the assembly kit further comprises at least one steel banding strap configured to be wrapped around the first compression arm and the first pile.

In certain embodiments of the foregoing, the first pile bracket has a mounting plate with a bent shape that enables different instances of the first pile bracket to be mounted onto different piles having different diameters.

Although the compression embers 132 and 832 are described as having the shape of a hollow tube having a square cross section, those skilled in the art will understand that, in alternative implementations, the compression members 132 and 832 may have other suitable shapes including, but not limited to, cylinders having circular cross sections.

Moreover, the present invention can be combined with additional support structure to restore the load-bearing capacity of the pier. For example, installers can wrap a section of a vertical wooden pile that is splitting, e.g., due to aging, with one or more steel banding straps in order to prevent further splitting of the pile, thereby restoring the load-bearing capacity of the responding pier. Installers can also wrap one or more tension-managing straps around two vertical wooden piles to maintain the horizontal distance between the piles in order to prevent the piles from buckling away from each other, thereby again increasing the load-bearing lateral strength of the corresponding pier. Note that two such tension-managing straps can be wrapped around two piles in a cross-bracing configuration, in which the straps are wrapped around the piles at opposing angles such that the straps cross each other at a horizontal location (e.g., the midpoint) between the two piles. These methods can be combined with the inventions described herein.

Although the invention has been described in the context of restoring the load-bearing capacity of existing damaged or degraded wooden piers, the invention can also be applied in other contexts, such as in piers made of suitable materials other than wood and/or in newly constructed piers.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain embodiments of this invention may be made by those skilled in the art without deparling from embodiments of the invention encompassed by the following claims.

In this specification including any claims. the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary, methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A cap repair assembly comprising: a first pile bracket configured to be rigidly mounted onto a first pile of a pier; a second pile bracket configured to be rigidly mounted onto a second pile of the pier; a cap beam configured to be rigidly mounted onto super-structure of the pier; a first cap beam plate rigidly mounted onto the cap beam at a first end of the cap beam; a second cap beam plate rigidly mounted onto the cap beam at a second end of the cap beam; a first compression arm rotatably connected (i) at a first end to the first pile bracket and (ii) at a second end to the first cap beam plate; and a second compression arm rotatably connected (i) at a first end to the second pile bracket and (ii) at a second end to the second cap beam plate; and at least one tension strap configured to be wrapped around the first and second piles and circumscribe the first and second compression arms.

2. The assembly of claim 1, wherein the first and second pile brackets are rigidly mounted onto substantially vertical, front-facing surfaces of the first and second piles; and the first and second cap beam plates are rigidly mounted onto a substantially horizontal, underside surface of the cap beam.

3. The assembly of claim 1, wherein:

the first compression arm is rotatable with respect to the first cap beam plate by about 90 degrees about a first axis of rotation and by about +/−10 degrees about a second axis of rotation orthogonal to the first axis of rotation;

the second compression arm is rotatable with respect to the second cap beam plate by about 90 degrees about first axis of rotation and by about +/−10 degrees about a second axis of rotation orthogonal to the first axis of rotation;

the first compression arm is rotatable with respect to the first pile bracket by about +/−90 degrees about a first axis of rotation and by about +/−10 degrees about a second axis of rotation orthogonal to the first axis of rotation; and the second compression arm is rotatable with respect to the second pile bracket by about +/−90 degrees about a first axis of rotation and by about +/−10 degrees about a second axis of rotation orthogonal to the first axis of rotation.

4. The assembly of claim 1, wherein the first cap beam plate comprises:

a mounting plate having first and second rows of different numbers of mounting slots;

two clevis plates rigidly connected to the mounting plate and having corresponding clevis pin holes; and two lifting loops rigidly connected to the mounting plate.

5. The assembly of claim 1, wherein the first compression arm comprises a hollow, metal tube having a lighter-than-water material inside the interior volume of the tube.

6. The assembly of claim 1, wherein:

an end connector assembly is rigidly connected to each end of the first compression arm; and each end connector assembly comprises a swivel bearing that enables the rotatable connection between the first compression arm and one of the first pile bracket and the first cap beam plate.

7. The assembly of claim 1, wherein the first pile bracket has a mounting plate with a bent shape that enables different instances of the first pile bracket to be mounted onto different piles having different diameters.

8. A method for configuring the cap repair assembly of claim 1, the method comprising the steps of:

(1) rigidly mounting the cap beam onto the super-structure;

(2) rigidly mounting the first and second cap beam plates onto the cap beam;

(3) rotatably connecting the first end of the first compression arm to the first pile bracket;

(4) rotatably connecting the first end of the second compression arm to the second pile bracket;

(5) rotatably connecting the second end of the first compression arm to the first cap beam plate;

(6) rotatably connecting the second end of the second compression arm to the second cap beam plate;

(7) rotating the first compression arm with respect to the first cap beam plate and rigidly mounting the first pile bracket to the first pile; and (8) rotating the second compression arm with respect to the second cap beam plate and rigidly mounting the second pile bracket to the second pile.

9. The method of claim 8, wherein:

step (1) is performed before step (2);

step (1) is performed before steps (5) and (6)

step (3) is performed before step (5);

step (4) is performed before step (6);

steps (3) and (5) are performed before step (7); and steps (4) and (6) are performed before step (8).

10. The method of claim 8, further comprising the step of:

(9) rigidly connecting an end connector assembly to each end of the first compression arm wherein:

step (9) is performed before steps (3) and (5), and each end connector assembly comprises a swivel bearing that enables the rotatable connection between the first compression arm and one of the first pile bracket and the first cap beam plate.

11. An assembly kit for the cap repair assembly of claim 1, the assembly kit comprising:

the first and second pile brackets;

the first and second cap beam plates; and a plurality of compression members and four end connector assemblies configured to form the first and second compression arms.

12. The assembly kit of claim 11, wherein the first cap beam plate comprises:

a mounting plate having first and second rows of different numbers of mounting slots;

two clevis plates rigidly connected to the mounting plate and having corresponding clevis pin holes; and two lifting loops rigidly connected to the mounting plate.

13. The assembly kit of claim 11, wherein at least one compression member comprises a hollow, metal tube having a lighter-than-water material inside the interior volume of the tube.

14. The assembly kit of claim 11, wherein the first pile bracket has a mounting plate with a bent shape that enables different instances of the first pile bracket to be mounted onto different piles having different diameters.

* * * * *